US005199906A

United States Patent [19]

Wang

[11] Patent Number: 5,199,906

[45] Date of Patent: Apr. 6, 1993

[54] ELECTRICAL CONNECTOR

[75] Inventor: Chuen-Guey Wang, Taipei, Taiwan

[73] Assignee: Trusty Industrial Co., Ltd., Taipei, Taiwan

[21] Appl. No.: 888,311

[22] Filed: May 27, 1992

Related U.S. Application Data

[63] Continuation of Ser. No. 653,309, Feb. 11, 1991, abandoned.

[51] Int. Cl.[5] ..... H01R 9/24

[52] U.S. Cl. ..... 439/723; 439/752

[58] Field of Search ..... 439/752, 724, 723, 638, 439/654

[56] References Cited

U.S. PATENT DOCUMENTS 3,631,380 12/1971 Bohn ..... 439/638

4,781,625 11/1988 Yang ..... 439/752

*Primary Examiner*—Gary F. Paumen

*Attorney, Agent, or Firm*—Cushman, Darby & Cushman

[57] ABSTRACT

Disclosed is an electrical connector, which comprises a connecting element having a conducting portion and two free ends; a first housing member and a second housing member, each of which has at least one opening for a free end of said connecting element to pass therethrough; an accommodating member having notched grooves formed around the surfaces thereof. The electrical connector is characterized in that the conducting portion of the connecting element is capable of being accommodated and thus hold secured along and within the notched grooves, the opening of the housing member is capable of allowing the free end of the connecting element to pass therethrough and to be secured therein. Moreover, male or female connectors can be connected to the free ends of the connecting elements, and thus to utilize the electrical connector as male-to-male, male-to-female, and female-to-female transferring devices.

4 Claims, 3 Drawing Sheets

ELECTRICAL CONNECTOR

This is a continuation of application Ser. No. 07/653,309, filed on Feb. 11, 1991, which was abandoned upon the filing hereof.

BACKGROUND OF THE INVENTION

1. Field of the Invention

The present invention relates generally to an electrical connector, which is small in size, easier to manufacture and assemble, and versatile in electrical connecting.

2. Description of Prior Arts

The electrical connectors have been widely used in computer, communication, and instrumentation equipments for connecting various devices or apparatuses together. As shown in FIG. 1, the present existing electrical connectors are unavoidably provided with connecting elements having a conductor portion B and two free ends A and C. As shown, one of the free ends A forms a soldering portion for connecting to a cable, or for inserting into a printed circuit board. The other free end C forms a connecting terminal for connecting either to a male connector or to a female connector.

The conductor portion B of the present existing electrical connectors are usually enclosed in a plastic-made accommodating member 10. Utilizing this conventional manner, the accommodating member of the electrical connector have to be redesigned to conform with different customized arrangements of the connecting elements. This makes the manufacture and assembly of the electrical connector more complicated, and thus more time- and cost-consuming. Besides, due to the problems encountered in the injection molding of the plastic-made accommodating members and in the impact force which can be endured by the molding accommodating member, the capabilities to reduce the size of the electrical connector and to enhance the complexity of the connecting elements in the accommodating member are limited.

Moreover, at the present time, no standard has been set forth for the gender of the connectors. Therefore, some of the connectors provided in the equipments may be male connectors, and some may be female connectors. Thus, for example, if a user finds that a connector in his equipment is a female one and the connector in his cable is also a female one, then a transferring device has to be utilized for connecting the two female connectors. A conventional transferring device is shown in FIG. 2. As shown, the two free ends of the connecting element form two connecting head *2a* and *2b*, and the plastic-made accommodating member 20 provides a slit 21 for the connecting element to "penetrate" therethrough and fixed therein. This technique, however, is still within the scope of enclosing the conductor portion of the connecting element within a plastic-made accommodating member. Consequently, this kind of transferring device also suffers from the same drawbacks as the aforementioned electrical connector.

If the distance between two adjacent connectors, i.e. two adjacent slits, need to be shortened to accommodate more connecting elements, not only the result of the injection molding process becomes unpredictable, but the impacting force may likely break up the slits. For these reasons, it becomes difficult to reduce the size of the electrical connector, or to enhance the complexity of the connecting element therein.

SUMMARY OF THE INVENTION

In view of the drawbacks of the aforementioned electrical connectors and the bottlenecks of their manufacturing techniques, it is, therefore, a primary objection of th present invention to provide an electrical connector which is small in size, facilitate manufacture and assembly, and enhance the complexity of connecting elements therein.

The electrical connector, in accordance with the present invention, comprises a connecting element having a conducting portion and two free ends; a first housing member and a second housing member, each of which has at least one opening for a free end of said connecting element to pass therethrough; an accommodating member having notched grooves formed around the surfaces thereof. The electrical connector is characterized in that the conducting portion of the connecting element is capable of being accommodated and thus hold secured along and within the notched grooves, the opening of the housing member is capable of allowing the free end of the connecting element to pass therethrough and to be secured therein. Male or female connectors can be connected to the free ends of the connecting elements, and thus form a male-to-male, a male-to-female, or a female-to-female connection.

A more detailed understanding of the present invention of an electrical connector can be achieved by a reading of the following detailed description in conjunction with the accompanying drawings.

DETAILED DESCRIPTION OF THE PREFERRED EMBODIMENTS

Figure 3:
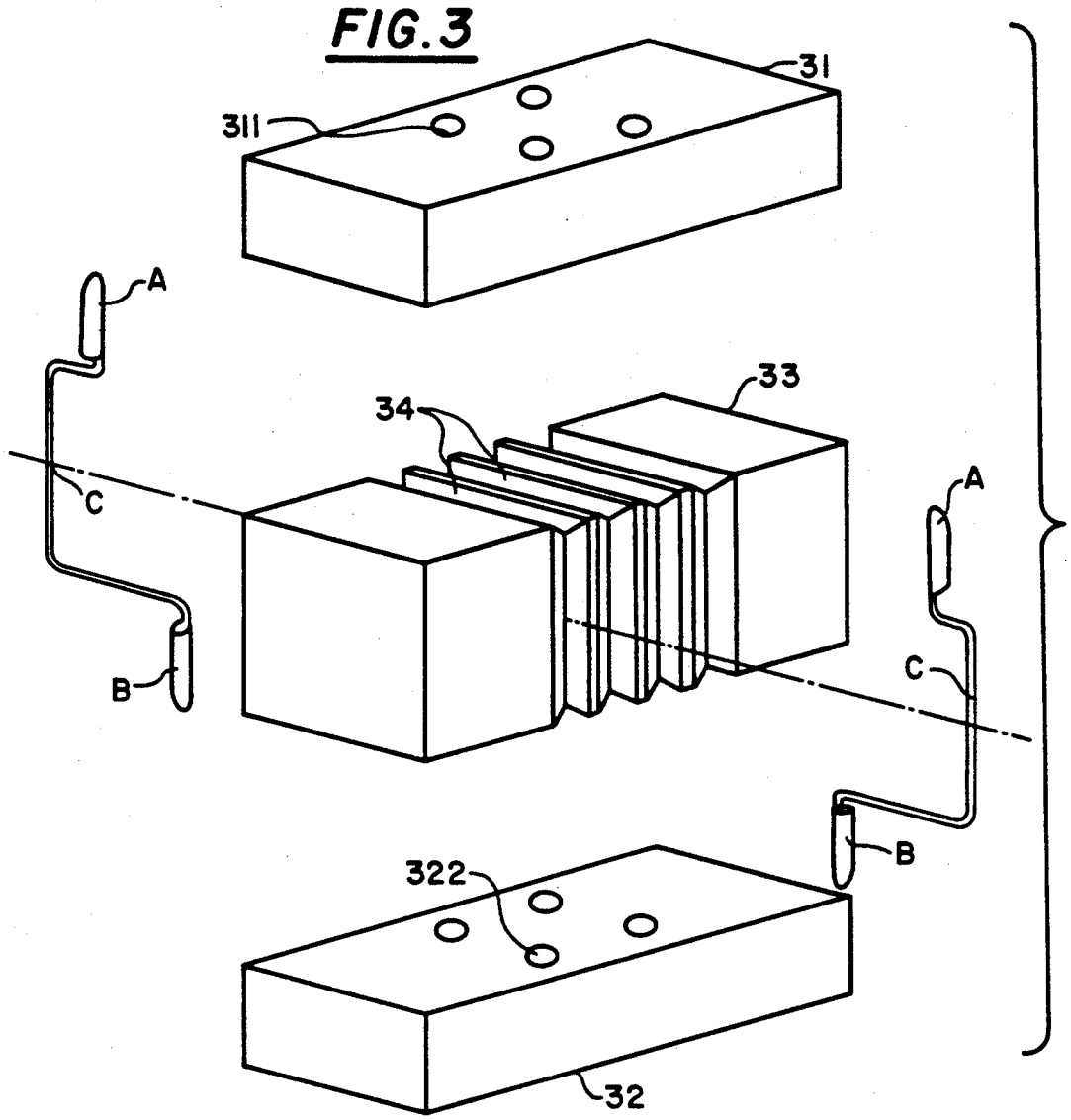
FIG. 3 shows an exploded perspective view of a preferred embodiment of an electrical connector according to the present invention.

Referring to FIG. 3, which is an exploded perspective view of a preferred embodiment of an electrical connector according to the present invention. As shown in the figure, the electrical connector comprises a plurality of connecting elements 30 (two in this embodiment) having a conducting portion C and two free ends A,B; two housing members 31 and 32, each of which has a plurality of openings 311,322 for the free ends A,B of the connecting element 30 to pass therethrough; and an accommodating member 33 having a plurality of notched grooves 34 formed around the surface thereof. The electrical connector is characterized in that the conducting portion C of the connecting elements 30 can be accommodated along and within the notched grooves 34, thereby the two free ends A,B of the connecting element 30 are positioned at the opposite sides of the accommodating member 33. The two free ends A,B are led out through the openings 311,322 of the housing member 31,32 and fixed thereto. The two housing members 31,32 together form a housing for the electrical connector. A male or a female connecting head (not shown) is then connected to each of the free ends A,B.

Figure 1:
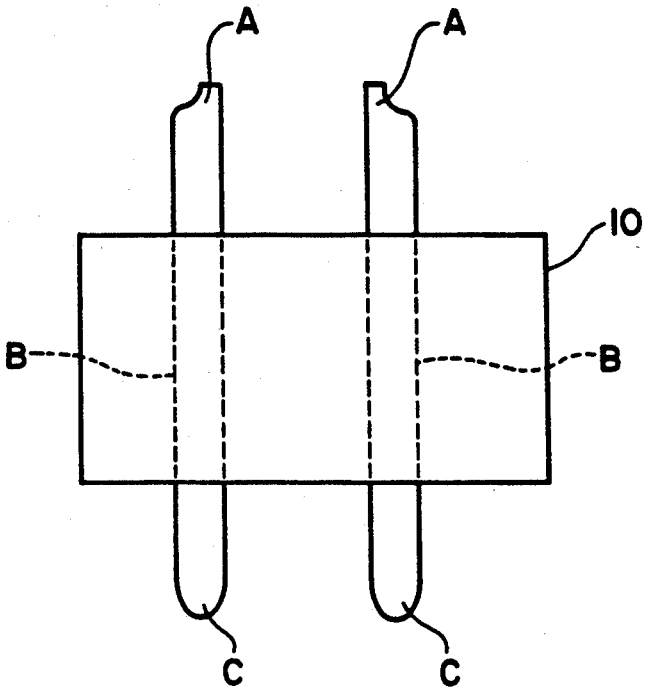
FIG. 1 (PRIOR ART)
FIG. 1 is a schematic representation of the prior art, showing a connecting element fixed within an accommodating member.
Figure 2:
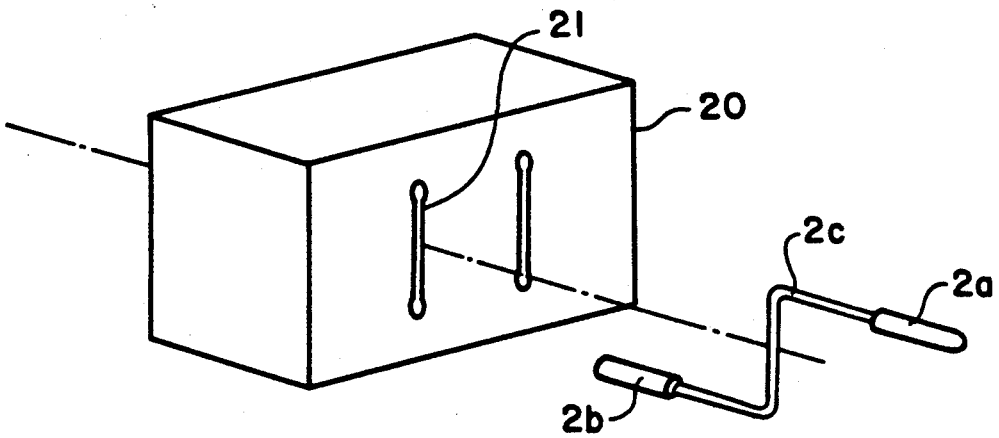
FIG. 2 (PRIOR ART)
FIG. 2 is an partially exploded perspective view of the prior art, showing a connecting element and its fixing slit.
Figure 4:
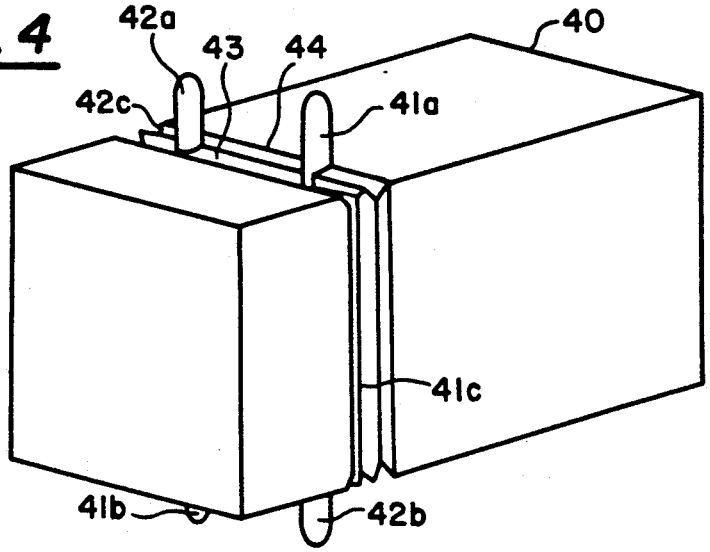
FIG. 4 is a perspective view of the electrical connector of the present invention, showing the assembly of the connecting element and the housing member.

Referring to FIG. 4, which is a perspective view of the electrical connector after being assembled, and two connecting heads 41*a*, 41*b* formed at the free ends of a connecting element are shown. At the present time, a miniature connecting head with a size of 1 mm (millimeter) is available. For two of these connecting heads to be accommodated in the prior electrical connector as depicted in FIG. 2, a distance of 1.27 mm is required between the two adjacent fixing slits. Whereas, utilizing the electrical connector according to the present invention, two connecting elements are able to be accommodated within a range of 1 mm. This is achieved by the provision of the notched grooves (i.e. whose cross section is V-shaped) to accommodated the conducting portion C of the connecting element 10. The conducting portion in this embodiment is made into a long metal plate with a width of 0.2 mm. Therefore, for the connecting head with a width of 1.0 mm, two grooves 43 and 44 can be notched for accommodating the conducting portions 41*c* and 42*c*. Even though the two grooves 43,44 are spaced from each other, the 1 mm width connecting heads 41*a* and 42*a*, however, still can be aligned with each other by adjusting the other connecting head 42*a* to the inverse direction, as shown illustratively in FIG. 4. Moreover, since the conducting portions 41*c* and 42*c* are "buried" in the notched grooves 43 and 44, the electrical connectors are free from being short-circuited. Thereby, the present invention facilitate the connecting heads to be arranged in a more complex manner in the electrical connector.

Figure 5A:
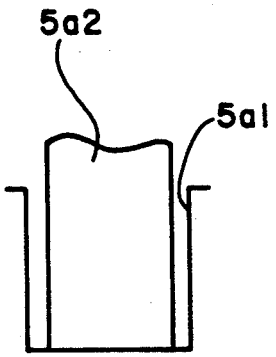
FIG. 5A is a sectional view of a conducting portion accommodated within a groove whose cross section is U-shaped.
Figure 5B:
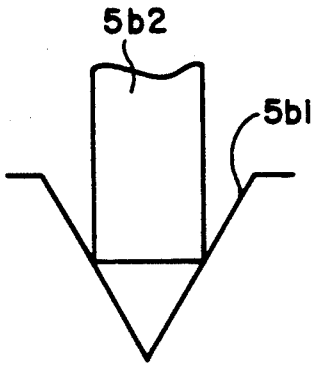
FIG. 5B is a sectional view of the conducting portion accommodated within a groove whose cross section is V-shaped.

As shown in FIGS. 5A and 5B, the advantages of the notched groove are more obviously depicted. Among the figures, FIG. 5A shows the U-shaped cross section of a conventional groove, and FIG. 5B shows the cross section of a notched groove. Due to some problems arising from the material and fabricating machine utilized, the dimension of the groove shown in FIG. 5 has been not easy to be fabricated precisely. The accommodation of the connecting element within such grooves has bee unsatisfactory. Whereas, the notched groove shown in FIG. 5B provides a much better securing function for the conducting portion accommodated therewithin. Besides, the notched groove is also easier to be fabricated than that shown in FIG. 5A.

Figure 6:
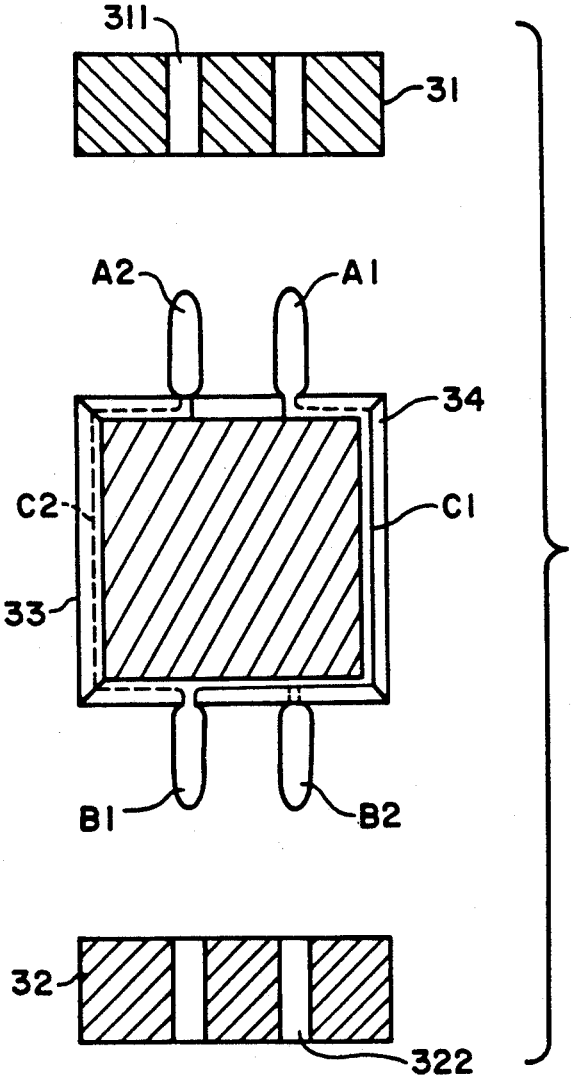
FIG. 6 is an exploded longitudinal cross sectional view of the electrical connector.

Referring to FIG. 6, which is an exploded longitudinal cross sectional view of the electrical connector shown in FIG. 3. As shown, two connecting elements are able to "cross" each other without being short-circuited, and to align their connecting head with each other.

Figure 7:
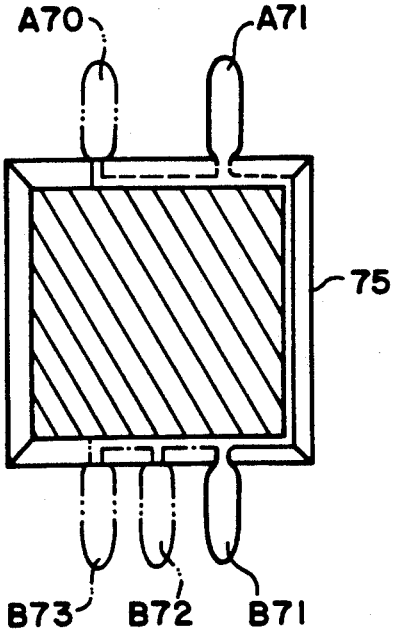
FIG. 7 is a longitudinal cross sectional view of another embodiment of the electrical connector.

As shown in FIG. 7, the connecting heads can be arranged in arbitrary positions according to the present invention. For example, the other end of a connecting head A70 can be positioned either at B71, or B72, or B73, and so as to form a A70-B71, a A70-B72, or a A70-B73 connection. As is the case with A71, a A71-B71, a A71-B72, or a A71-B73 connection could be formed. The connection according to the present invention is thus versatile.

Accordingly, the electrical connector of the present invention, characterized in the notched grooves on the surface of the accommodating member, is small in size, provides more complexity in the arrangement of the connecting elements, and facilitates the manufacture and assembly. In addition to these benefits, the free ends of the connecting elements can be connected to either male or female connectors, and thus also be utilized as a transferring device. The advantages, benefits and improvements of the electrical connector according to the present invention are obviously and have been clearly described hereinbefore.

While the invention has been described by way of example and in terms of a preferred embodiment, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical connector for electrically connecting a first device having a first connector to a second device having a second connector, said electrical connector comprising:

a first connecting element having a conducting portion, a first free end of said first connecting element being connected to a first end of the conducting portion and compatible with the first connector, and a second free end connected to a second end of said conducting portion and compatible with the second connector; and an accommodating member substantially in the shape of a cube, said accommodating member having at least one notched groove formed around the periphery thereof;

wherein said conducting portion is accommodated within the notched groove so that said first free end and said second free end are arranged respectively at opposite faces of said accommodating member and the notched groove has a depth substantially equal to a diameter of said conducting portion of said first connecting element.

2. An electrical connector according to claim 1, further comprising:

a case enclosing said accommodating member, said case including a plurality of holes, said first free end and said second free end passing through and fixed by said holes.

3. An electrical connector according to claim 1, wherein said conducting portion has a rectangular cross-section along a plane passing through said at least one notched groove.

4. An electrical connector according to claim 1, wherein said at least one notched groove is contiguous along at least four faces of said accommodating member.

* * * * *